United States Patent [19]

Potteiger et al.

[11] 4,004,518

[45] Jan. 25, 1977

[54] SELF-FORGING FRAGMENTATION DEVICE

[75] Inventors: Lester A. Potteiger; William G. Soper; James C. Talley, all of Dahlgren, Va.

[73] Assignee: The United States of America as represented by the Secretary of the Navy, Washington, D.C.

[22] Filed: June 21, 1965

[21] Appl. No.: 465,804

[52] U.S. Cl. ..... 102/67; 102/56 SC

[51] Int. Cl.[2] ..... F42B 13/48

[58] Field of Search ..... 102/2, 6, 38, 39, 43, 102/56–59, 63, 67, 68

[56] References Cited

UNITED STATES PATENTS

| | | | |
|---|---|---|---|
| 608,125 | 7/1898 | Hurst | 102/56 |
| 735,658 | 8/1903 | Dunn | 102/67 |
| 1,276,082 | 8/1903 | Kuhn | 102/67 |
| 2,791,178 | 5/1957 | Thompson | 102/67 |
| 2,948,218 | 8/1960 | Pearson et al. | 102/67 |
| 3,081,704 | 3/1963 | Boswell | 102/63 |
| 3,103,888 | 9/1963 | Rosenthal | 102/66 |

*Primary Examiner*—Verlin R. Pendegrass

[57] ABSTRACT

There is disclosed an explosive device consisting of a thin-walled metal casing whose cross section consists of identical V-shaped sectors, which are joined to each other by means of a soldered butt connection. Because of a relatively small radius and weaker structure at the joint than at the V-intersection, separation upon explosion occurs at the solder joint first, yielding a fragment that provides greater penetration power over a wider range of stand-off distance.

7 Claims, 8 Drawing Figures

FIG. 1,
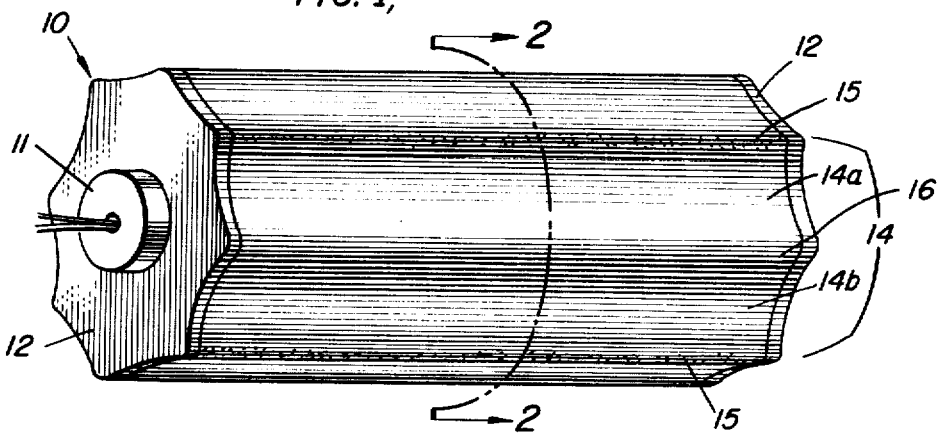
FIG. 2
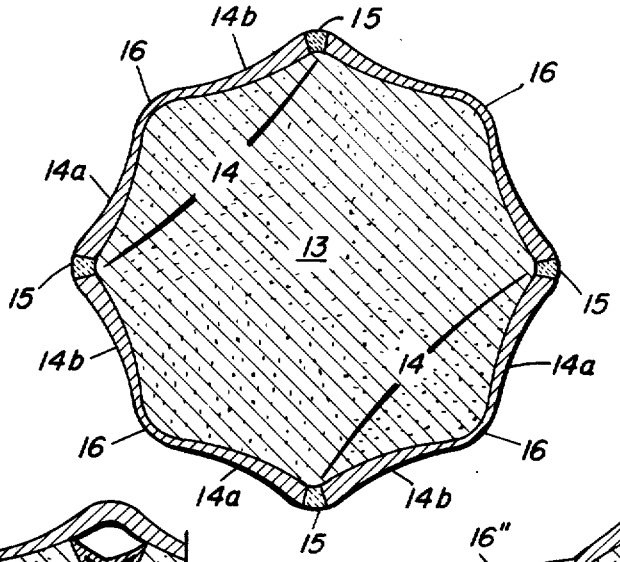
FIG. 4
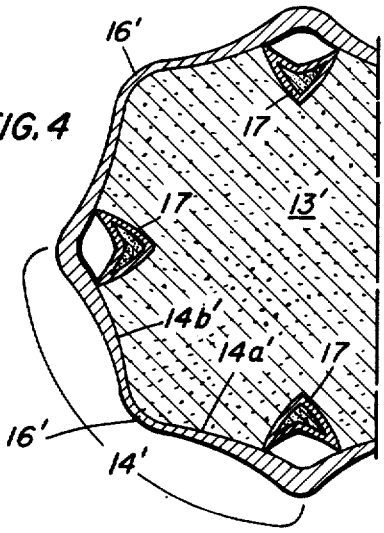
FIG. 5
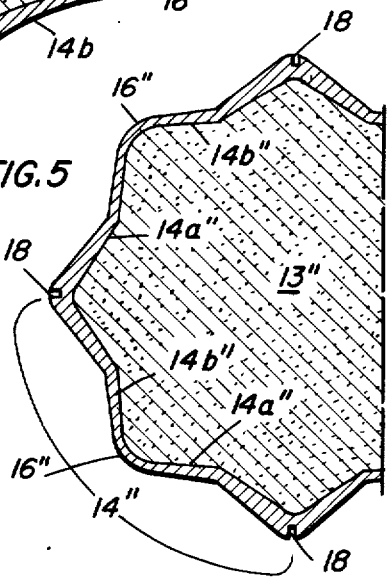
INVENTOR
LESTER A. POTTEIGER, WILLIAM G. SOPER, and JAMES C. TALLEY
Claude Funkhouser
ATTORNEY
BY
Richard D. Gauer
AGENT

SELF-FORGING FRAGMENTATION DEVICE

The invention described herein may be manufactured and used by or for the Government of the United States of America for governmental purposes without the payment of any royalties thereon or therefor.

This invention relates generally to ordnance devices and more particularly to fragmentation type explosive devices.

It is well known that the effectiveness of a projectile intended for the penetration of heavy or armored targets is directly proportional to the projectile length as measured along its line of flight. The depth of the cut made in the target is therefore a function of both the size and attitude in flight of the projectile. Although it has been possible heretofore to partially control the size or shape or attitude in flight of an explosively created fragment, it has not been possible to systematically control all three of these in the manner or to the degree in which they are controlled by the self-forging fragmentation device.

Accordingly, it is a principle object of this invention to provide a fragmentation type ordnance device having improved target penetration capability.

An additional object of this invention is to provide a fragmentation type ordnance device wherein the size of the explosively produced fragments may be readily controlled.

It is another object of this invention to provide a fragmentation type ordnance device wherein the shape of the explosively produced fragments may be readily controlled.

It is a still further object of this invention to provide a fragmentation type ordnance device wherein the attitude in flight of the explosively produced fragments may be readily controlled.

Other objects and many of the attendant advantages of this invention will be readily understood by reference to the following detailed description when considered in connection with the accompanying drawings wherein:

FIG. 1 is a perspective view of the explosive device of this invention;

FIG. 2 is a typical cross-sectional view of the device taken along line 2—2 of FIG. 1;

FIG. 4 is a typical fragmentary cross-sectional view similar to FIG. 2 showing a first modification of the device;

FIG. 5 is a typical fragmentary cross-sectional view similar to FIG. 2 showing a second modification of the device;

The depth to which a fragment will penetrate a target is substantially proportional to the momentum per unit area of the fragment. This quantity may be derived and expressed as follows:

$$\text{Momentum} = mv = \rho ALv$$

-continued $$\frac{\text{Momentum}}{\text{Unit Area}} = (\rho v)L$$

where $m$ is the fragment mass, $v$ is the fragment velocity, $\rho$ is the density of the fragment, $A$ is the frontal area of the fragment, and $L$ is the length of the fragment measured parallel to its velocity vector. For a given fragment and velocity, it can be seen that the quantity in the parenthesis of the above equation will be a constant, and that therefore the momentum per unit area or penetration capability of the fragment is proportional to $L$.

Figure 6:
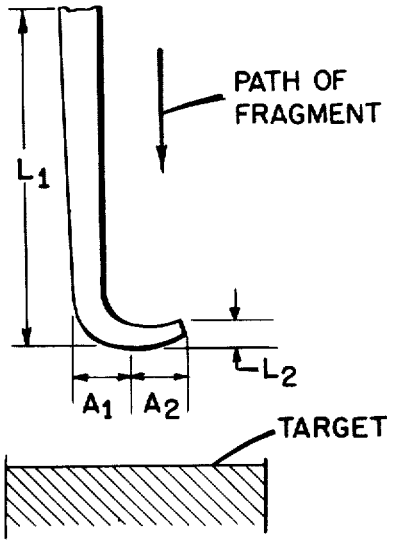
FIG. 6 is a diagram illustrating a J-shaped fragment just prior to impact against a target.
Figure 7:
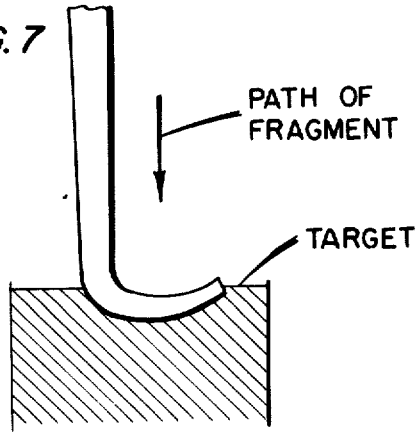
FIG. 7 is a diagram illustrating an early stage of impact of the fragment of FIG. 6.
Figure 8:
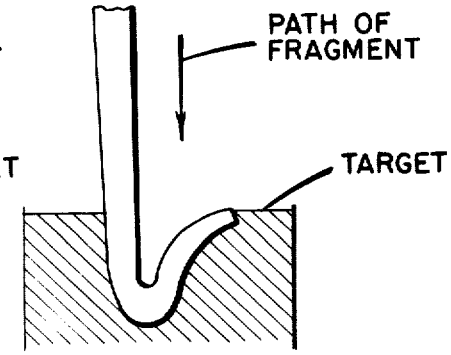
FIG. 8 is a diagram illustrating a later stage of impact of the fragment of FIG. 6 and FIG. 7.

This phenomenon is illustrated in FIGS. 6, 7, and 8. FIG. 6 illustrates a substantially J-shaped fragment just prior to its impact against a solid target. The projected frontal area of the fragment perpendicular to its line of flight has been divided into two equal parts in FIG. 6, designated as $A_1$ and $A_2$. The lengths of the corresponding portions of the fragment measured along the fragment flight path are designated as $L_1$ and $L_2$, respectively. In accordance with the above equation, the momentum of the two portions of the fragment would therefore be proportional to $L_1$ and $L_2$, respectively. As shown in FIG. 8, the depth of the cut made by impact of the fragment is substantially deeper at the section of the fragment having the greater value of $L$.

Thus the ideal fragment would have its long axis aligned with its line of flight. In order to realize the full penetration potential of a fragment it becomes desirable to devise a means for controlling the attitude of the fragment in flight. This control is achieved by the unique fragmenting explosive device of this invention.

As shown in perspective in FIG. 1, the explosive device 10 is generally prismatic in shape having eight fluted sides. Detonator 11 is mounted in one of the two end plates 12 which enclose the ends of the device. As can be seen by reference to FIG. 2, an explosive charge 13 completely fills the enclosure defined by plates 12 and by a thin-walled casing. The casing comprises four identical segments 14, which are joined together by butt type solder joints 15. Casing segments 14 each comprise two mirror-image elements, 14*a* and 14*b*, each of which will produce a single fragment upon detonation of charge 13. Each element 14*a* or 14*b* of the casing thus constitutes a sector of the eight-sided prismatic device.

It will be noted from FIG. 2 that the cross-section of each of the casing elements 14*a* and 14*b* is asymmetric. The thickness of the casing is greatest at the end adjacent solder joint 15, and this thickness decreases toward the creased end 16 of the element. The respective ends of each casing element are dissimilar in two other respects. The radius of curvature at crease 16 is greater than at the solder joint 15. Structurally, lateral edge 16 is substantially stronger and more blast resistent than the solder joint 15. The purpose and effect of the above described geometric characteristics will be more readily understood by reference to FIG. 3. The casing is constructed in such a manner that there will be a drastic discontinuity in strength at the solder joint 15. It is desirable to have a substantially weaker zone along joint 15 in order to assure that, upon detonation of the charge, the casing will initially fail along joints 15, before any substantial expansion, change in shape, or fracture of the balance of the casing. As a result of this early failure, a substantial portion of the blast energy in that zone will be released through the opening in the casing. This reduction in the quantity of blast energy available in the joint zone, coupled with the higher inertia of the joint end of each element resulting from the greater wall thickness there, produces a lower acceleration at the joint end of each element than at the crease end of each element.

Figure 3:
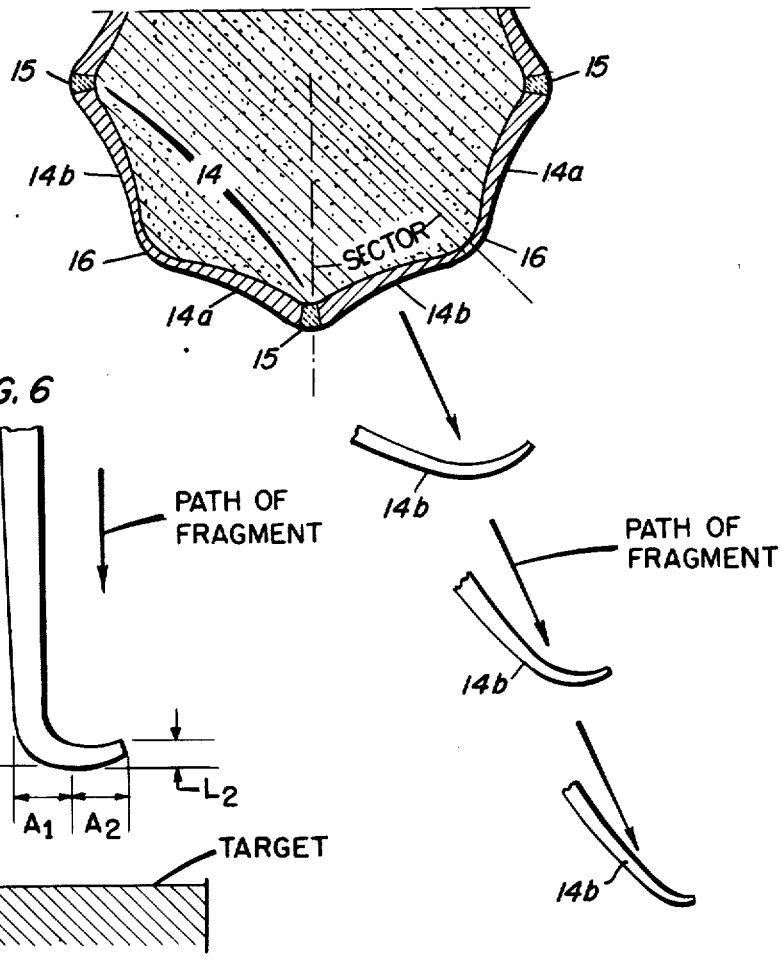
FIG. 3 is a sequential diagram showing the progressive change in shape and attitude of a single fragment following detonation of the charge.

Thus, as is evident from the sequence of positions of a typical fragment illustrated in FIG. 3, the faster moving crease end of the fragment has traveled farther in each stage of its flight than has the joint end. The fragment, originally V-shaped as a part of the casing, is gradually forged as a result of detonation of the explosive charge into a J-shaped or I-shaped fragment with its long axis aligned with the fragment line of flight. In this manner, the desired edge-on attitude of the fragment is achieved, and the resulting momentum per unit area of the fragment is maximized.

It will be noted from FIG. 2 that the cross-section of each sector has a concave configuration. This concavity tends to produce convergence of the accelerated casing elements, and thus to offset the slight divergence and tearing observed with flat casing sectors. This convergence results from the fact that the direction of projection of a casing element is influenced by the orientation of the casing-explosive interface; a concave interface tends to focus the elemental trajectories toward a single point of smaller area, thereby preventing undesired splitting of the casing at points intermediate the lateral edges.

A modification of the device is illustrated in FIG. 4. In this embodiment the adjacent segments 14' are not soldered together as in the embodiment of FIG. 2, but rather the entire casing is integrally formed. The casing might be readily fabricated by an extrusion process, and would provide greater structural rigidity than the solder joint embodiment. The desired initial failure of the casing at the intersection of adjacent segments is achieved by means of a linear shaped charge 17 located adjacent the interior junction between each pair of segments and running the entire length of the casing.

A second modification of the device is illustrated in FIG. 5, where each of the segments 14'' has a dog-leg shape rather than the concave shape of the embodiments of FIGS. 2 and 4. The exterior of the casing has a longitudinal notch 18 at each of the junctions of segments 14''. These notches provide an inherent localized weakness in the casing, which, upon detonation of the charge 13'', will provide the desired initial severence of these alternate lateral edges.

While the device has been described and illustrated as embodied in a prismatic configuration, it is to be understood that other polyhedral casing configurations might be employed. The principal parameters involved in the selection of casing shape are the type of target and the shape and number of fragments desired. Detonation of the charge at one end of the illustrated prismatic casing produces fragments having a length equal to the length of the prism. Other fragment configurations could be produced by the use of multi-point or continuous axial initiation of the charge. Similarly, casings of uniform thickness or with straight sided sectors may be employed, as may devices having a central or otherwise void, explosive free, area or areas within their interior.

Employment of the unique explosive device of this invention substantially improves the target penetrating potential of the explosively formed fragments. This improved performance is achieved by the use of a high ratio of explosive charge to casing mass, by a non-uniform casing wall thickness, and by a non-uniform application of shock wave impulse to the periphery of the casing. The latter feature is achieved by the use of concave sectors and by various means for creating an initial casing failure in predetermined locations, that is, both the direction and magnitude of the impulse applied to the casing are controlled.

Obviously many modifications and variations of the present invention are possible in the light of the above teachings. It is therefore to be understood that within the scope of the appended claims the invention may be practiced otherwise than as specifically described.

What is claimed is:

1. In a fragmentation-type ordnance device of a character including a thin-walled substantially polyhedral casing from which a single fragment is produced from each of the lateral faces of said casing, the improvement which comprises a first means including an explosive charge;

a second means for initially severing said casing along a first series of alternate lateral edges and subsequently severing said casing along the remaining alternate lateral edges; acceleration said second means further imparting an accelerating force to the casing fragments thereby created to produce a greater acceleration of the subsequnetly severed edges than that of said first series of edges, whereby a plurality of ribbon-like fragments are produced and wherein the leading edge of each of said fragments is one of said remaining alternate lateral edges.

2. The ordnance device of claim 1 wherein each of the lateral faces of said casing is fluted.

3. The ordnance device of claim 1 wherein said casing is substantially prismatic in shape.

4. The ordnance device of claim 3 wherein each of the sides of a polygon defined by the bases of said substantially prismatic casing has concave sides.

5. The ordnance device of claim 3 wherein the wall thickness of each of the sides of said casing varies from a maximum at said first series of lateral edges to a minimum at each of said remaining lateral edges.

6. The ordnance device of claim 3 wherein said means further includes a linear shaped charge disposed to extend along the interior of each of said first series of lateral edges.

7. The ordnance device of claim 3 wherein an inherent local structural weakness of said casing along each of said first series of lateral edges functions to effect initial casing failure at each of said first series of lateral edges.

* * * * *